United States Patent [19]

Bowman et al.

[11] Patent Number: 5,054,189

[45] Date of Patent: Oct. 8, 1991

[54] METHOD OF MANUFACTURING AN ELECTRICAL SLIP RING ASSEMBLY

[75] Inventors: Anthony L. Bowman; Norris E. Lewis; Jerry T. Perdue; James M. Wright; Michael J. Day, all of Blacksburg, Va.

[73] Assignee: Litton Systetms, Inc., Beverly Hills, Calif.

[21] Appl. No.: 603,155

[22] Filed: Oct. 25, 1990

[51] Int. Cl.[5] ..... H01R 43/04

[52] U.S. Cl. ..... 29/597; 29/525; 29/733; 310/232; 439/25

[58] Field of Search ..... 29/597, 525, 733; 310/42, 232, 236; 439/24–26

[56] References Cited

U.S. PATENT DOCUMENTS 4,837,920 6/1989 Sweet et al. ..... 29/597

*Primary Examiner*—Carl E. Hall

*Attorney, Agent, or Firm*—Gerald L. Lett

[57] ABSTRACT

A method of manufacturing an annular base portion of an electrical slip ring assembly having a plurality of conductive rings formed in the outer circumferential surface thereof is described. The slip ring base is molded, and grooves are machined into the outer circumferential surface thereof. Conductive strips are cut into a series of lengths forming conductive rings to be placed about the outer circumference of the annular base member. The individual lengths of conductive material are anchored to the outer circumferential surface of the slip ring base and a rolling pressure is exerted on them about the circumference of the base to cause the rings to be press fit into the grooves previously formed on the base. When the complete circumference of the ring has been press fit into its respective groove, the other end of the conductive ring is then secured to the base. An appropriate fixture is provided for exerting the lateral and a rolling pressure on each conductive ring to properly press fit it into a groove on the annular base member.

5 Claims, 1 Drawing Sheet

METHOD OF MANUFACTURING AN ELECTRICAL SLIP RING ASSEMBLY

BACKGROUND OF THE INVENTION

This invention relates to a method of manufacturing an electrical slip ring assembly. More particularly, the method relates to constructing a slip ring assembly base having a plurality of conductive rings therearound.

Electrical slip rings are well known devices for communicating electrical signals from one structural member to another where one of the structural members is rotatable with respect to the other. Such a slip ring assembly, for example, may comprise a relatively stationary annular base member which has a plurality of conductive rings extending around an outer circumferential face thereof. Each of the rings extends around a substantial portion of the circumference of the slip ring base. A series of electrically conductive brushes are arranged on a relatively rotatable structural member to rotate about the slip ring base, and each of the brushes is arranged to contact a surface of one of the conductive rings thereby forming a series of electrical connections between the two structural members.

Heretofore, the methods of manufacturing slip ring bases of the type discussed herein above have included either molding the conductive rings as a part of the base while the base itself is being molded or plating the conductive rings into previously completed slip ring bases having grooves formed therein for the conductive rings. Both techniques require expensive tooling and machining operations which are now proving to be prohibitively expensive.

In connection with the molding process mentioned above, it is necessary that conductive rings be positioned within a mold so that, for example, epoxy can be cast around the rings to produce the slip ring base. Expensive tooling is required to support and maintain the rings at the proper position as the molding process is carried out. These rings are then plated, once the molding process has been completed, and this requires additional tooling. Using this technique, if the casted epoxy happens to have voids or otherwise does not properly bond to the conductive ring materials, it is not unusual to find that plating solutions can be trapped in the epoxy or around the rings. After a short period of use of the slip ring, these solutions can migrate to the ring surfaces and cause excessive wear and intermittent electrical contact problems.

Using those techniques where plating occurs after molding, it is not unusual to find that the plating does not adhere properly to the base member. In this event, the conductive rings must be removed, remachined and replated. It can readily be seen that these will be expensive and time consuming operations. In many cases it is not possible to repair the damage and at least the entire slip ring base must be discarded. This loss is a significant one.

SUMMARY OF THE INVENTION

The foregoing and other disadvantages of prior art manufacturing techniques for slip ring bases are overcome using a method of manufacture according to the principles of the invention.

The annular slip ring base is molded or otherwise formed according to known principles. At this point, grooves are machined into the outer circumferential surface of the slip ring base. These grooves may be formed in accordance with the cross sectional size and shape of the linear material which will form the conductive rings to be placed about the circumference of the slip ring base. The conductive material which may be in a continuous strip form is cut to a series of lengths forming the conductive rings. Each length of conductive material, at this point, has formed therein a groove adapted to receive a slip ring brush. The individual lengths of conductive material are then anchored at one end to the outer circumferential surface of the slip ring base, and a rolling pressure is exerted on them around the circumference of the base to cause the rings to be press fit into the grooves previously formed on the base. The other ends of the conductive rings are then secured to the base.

The result of using the method of manufacture according to the invention, as discussed above, is to substantially remove the need for all of the expensive tooling discussed herein above, and to create a reliable method of manufacture which produces greater percentages of usable slip ring assemblies from the quantity being manufactured.

DETAILED DESCRIPTION OF THE PREFERRED EMBODIMENT

Figure 1:
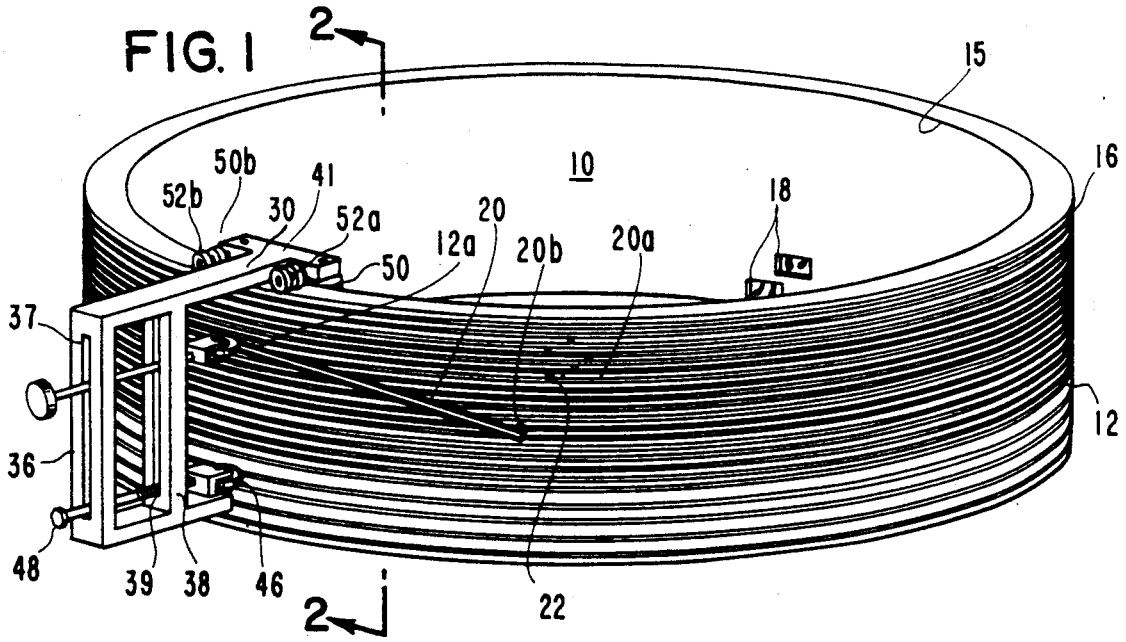
FIG. 1 is a perspective view of an annular base member for an electrical slip ring assembly which is in the process of being constructed according to the principles of the invention, and a perspective view of a fixture mounted on the annular base member for performing steps of the method of the invention.
Figure 2:
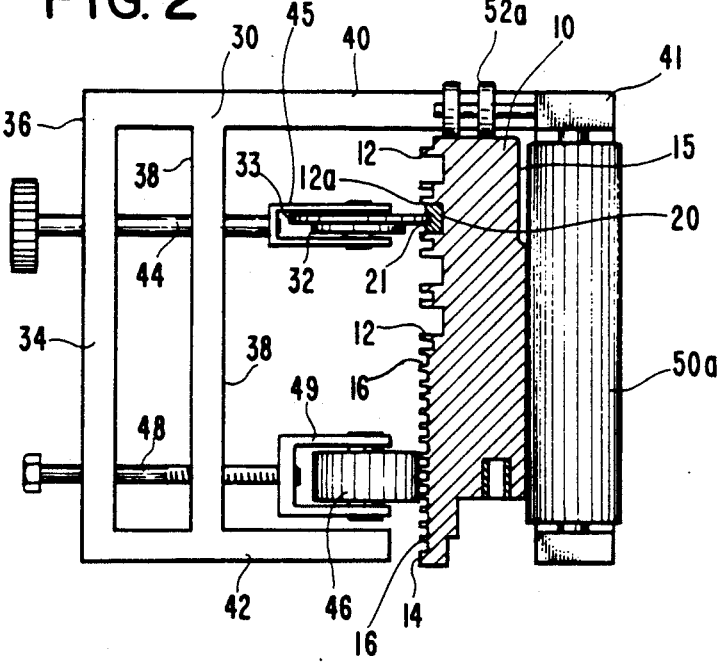
FIG. 2 is a side partial cross sectional view taken along the line 2—2 of FIG. 1 illustrating in greater detail a preferred embodiment of a fixture for performing the method according to the invention and its relationship to annular base member.

In FIGS. 1 and 2 like reference numerals refer to like elements.

FIG. 1 provides a perspective view of a typical annular base member 10 for an electrical slip ring assembly having a plurality of conductive rings placed therearound to carry both signal voltages and operating power. Annular base member 10 may be formed from materials such as epoxy using known casting or molding techniques. A series of relatively wider circumferential grooves 12 are then machined in a portion of the outer circumferential surface 14 of base member 10. In addition, a series of relatively narrower circumferential grooves 16 are machined in another portion of outer circumferential surface 14. The cross sectional shapes of grooves 12 and 16 are selected to substantially conform to the shape of conductive strips to be mounted therein and the fiber brushes to be used in connection with those conductive strips in accordance with known electrical slip ring construction techniques. In FIGS. 1 and 2, only one of grooves 12, referred to as groove 12*a* is shown as having a conductive strip partially placed therein.

The ends of conductive strips, when placed in the grooves, are anchored by pins or bolts. Access to these pins or bolts may be had from the inner circumference surface 15 of the annular base member through a series of openings 18, one of which may be provided for each grove.

As previously discussed, individual lengths of conductive material form conductive strips, such as conductive strip 20. As best shown in FIG. 2, each conductive strip 20 has in the outer surface thereof formed a groove 21 adapted to receive one of the series of brushes to be mounted on a rotating portion of the electrical slip ring assembly (not shown). Each conductive strip or ring is formed from a roll of conductive material such as brass or copper. A groove 21 is pressed into the material by passing it through a conventional rolling machine (not shown). The material is then cut to length and mounting studs are brazed to the ends of the ring. The rings are then plated.

As seen in FIG. 1, conductive strip 20, so formed, is being placed in groove 12*a*, and a first end 20*a* of conductive strip 20 has already been fastened in the known manner to annular base member 10. The other end of conductive strip 20 illustrated at 20*b* has not yet been pressed into groove 12*a*, and end 20*b* has not yet been fastened to annular base member 10. A hole 22 is provided in groove 12*a* through which end 20*b* can be fastened to the annular base member. Similar openings are provided for each conductive ring in each groove. These openings are accessible through windows 18 in surface 15.

As previously pointed out, the method according to the invention contemplates that each conductive strip or ring, such as conductive strip 20 is first fastened at an end thereof, in this case end 20*a*, to one of the openings 22 in annular base member 10. In this particular case groove 12*a* is the groove into which conductive strip 20 is to be placed. At this point in the process, conductive strip 20 is to be press fit into groove 20 by means of a rolling pressure exerted on it using fixture 30.

The portion of fixture 30 which actually exerts the pressure on conductive strip 20 is pressure roller member 32 having an outer circumferential surface 33 shaped similarly to groove 21 in conductive strip 20, which grove conforms to the shape of the brush to be used in the slip ring assembly.

Fixture 30 includes a frame 34 having vertical support members 36 and 38 joined to horizontal support members 40 and 42. Vertical members 36 and 38 have formed therein vertically elongated openings 37 and 39 for receiving adjustable arm 44 which rotatably carries roller member 32 in its bifurcated end 45. Arm 44 may, for example, be threadibly engaged with vertical member 38 to adjustably provide the desired lateral positioning of roller member 32, and the elongated shapes of openings 37 and 39 provide for the proper vertical positioning of the pressure roller member.

In addition, a support roller 46 is rotatably mounted in bifurcated end 49 of a second adjustable arm 48 which also extends through openings 37 and 39. Arm 48 can be threadibly adjusted to provide proper lateral support on the exterior circumferential surface and to ensure that roller member 32 is carried in a true horizontal position.

In order to provide proper positioning lateral pressure on the interior circumferential surface of annular base member 15 for fixture 30 there are provided a pair of cylindrical support rollers 50*a* and 50*b*. The latter rollers are rotatably mounted in the illustrated manner to an outer "T" shaped end 41 of horizontal support member 40. In addition, horizontal support member 40 has laterally attached thereto vertical support rollers 52*a* and 52*b* which are needed to facilitate motion of the entire fixture 30 about the circumference of annular base member 10.

In forming each of the conductive rings 20 into its respective groove 12*a*, as stated, end 20*a* is attached to annular base member 10. At that point, fixture 30 is placed in engagement with annular base member 10 as shown in FIGS. 1 and 2. Roller member 32 is adjusted to exert a sufficient lateral pressure on conductive strip 20 as to firmly press fit it into groove 12*a*. The entire fixture is then rotated, in this case by hand, about the circumference of annular base member 10 in a counterclockwise fashion in this example. In FIG. 1 the fixture 30 is shown to have been rotated to approximately the 8 o'clock position having started at approximately the 6 o'clock position, and the portion of conductive strip 20 with the exception of the end 20*b* is shown as having been press fit into groove 12*a*. As is clear from the construction of fixture 30, at the same time, a significant circumferential force is exerted by the motion of roller member 32 so that the conductive strip is slightly elongated so that ends 20*a* and 20*b* will be in substantial abutment when the entirety of conductive strip 20 is in place, and end 20*b* can be fastened through opening 22.

The method according to the invention, therefore, provides an efficient method for forming conductive rings into grooves in annular based member portions of electrical slip ring assemblies. The method is devoid of the problems encountered when using prior art techniques, as discussed above. It produces significantly greater production yields of slip ring assemblies. Slip ring assemblies manufactured according to the invention have greater long term reliability because the conductive rings are not subject to the life-reducing problems introduced by prior art manufacturing techniques.

A preferred embodiment of a structure utilizing the principles of the invention has been described above in detail. However, various modifications to the structures described may be made and will occur to those skilled in the art without departing from the spirit and scope of the invention as claimed herein below.

We claim:

1. A method of manufacturing a base for an electrical slip ring assembly comprising the steps of:

casting an annular slip ring base, said base having inner and outer diameter circumferential faces, forming annular grooves in the outer diameter face of said slip ring base, said grooves being adapted to receive rings of electrically conductive material, cutting linear electrically conductive material to lengths, each length substantially corresponding to the circumference of said outer diameter face of said slip ring base, thereby forming a plurality of electrically conductive rings, anchoring corresponding ends of said conductive rings, respectively, at corresponding points on said annular grooves, pressing said conductive rings into engagement within said annular grooves to form a plurality of annular electrically conductive rings about said outer diameter face of said slip ring base and securing the other ends of said conductive rings to said slip ring base.

2. The method defined in claim 1 wherein said pressing step comprises exerting a rolling pressure along the length of said conductive rings progressively around the circumference of said outer diameter face so that said conductive rings are pressed into the interiors of said annular grooves.

3. The method defined in claim 1 comprising the additional step of:

forming, after said cutting step, a groove in outwardly facing surfaces of each said conductive ring, each said conductive ring groove being adapted to receive conductive engagement of a slip ring brush.

4. The method defined in claim 3 wherein said step of forming grooves in said conductive rings comprises causing a roller having pressure exerted thereon to travel the length of said conductive ring, said roller having a boss protruding from and extending around the outer circumference thereof which is the size and shape of the groove to be formed in said conductive rings.

5. The method defined in claim 2 wherein said pressing step further comprises exerting a rolling pressure on said conductive rings using a roller mounted on an arm means which extends to and is rotatably connected to a spindle extending substantially along the axis of said slip ring base while moving the arm means about the circumference of said annular base member.

* * * * *